US009617747B2

(12) United States Patent
Seto et al.

(10) Patent No.: US 9,617,747 B2
(45) Date of Patent: Apr. 11, 2017

(54) FOLDING GUARD RAIL METHOD AND APPARATUS

(71) Applicants: John Seto, Orlando, FL (US); Ronnie J. Jones, Windermere, FL (US)

(72) Inventors: John Seto, Orlando, FL (US); Ronnie J. Jones, Windermere, FL (US)

( * ) Notice: Subject to any disclaimer, the term of this patent is extended or adjusted under 35 U.S.C. 154(b) by 875 days.

(21) Appl. No.: 13/943,946

(22) Filed: Jul. 17, 2013

(65) Prior Publication Data

US 2015/0023774 A1 Jan. 22, 2015

(51) Int. Cl.
*E04G 21/32* (2006.01)

(52) U.S. Cl.
CPC ..... *E04G 21/3228* (2013.01)

(58) Field of Classification Search
CPC .. E04G 1/34; E04G 5/04; E04G 5/041; E04G 21/3228; E04G 21/3223; E04H 17/22
See application file for complete search history.

(56) References Cited

U.S. PATENT DOCUMENTS 4,084,277 A * 4/1978 Conrad et al. ..... G03B 42/025 5/100
4,123,882 A * 11/1978 Case et al. ..... E04G 21/142 294/15
4,520,898 A 6/1985 Allemane
5,732,911 A * 3/1998 Kulp et al. ..... G09F 15/0056 248/158
5,749,436 A 5/1998 Satchwell, III
6,053,281 A 4/2000 Murray
7,028,990 B2 4/2006 Shorey et al.
7,243,450 B2 * 7/2007 Dicke et al. ..... G09F 15/0056 248/167
8,689,938 B2 * 4/2014 Kenton et al. ..... E04G 21/3233 182/113
2006/0278472 A1 12/2006 Kenton et al.

FOREIGN PATENT DOCUMENTS

DE 295 00 048 * 4/1995 ..... E04G 3/08
FR 2 600 102 * 12/1987 ..... E04G 3/08
WO WO 2009/118667 * 10/2009 ..... E04G 21/32

* cited by examiner

*Primary Examiner* — Michael P Ferguson
(74) *Attorney, Agent, or Firm* — William M. Hobby, III

(57) ABSTRACT

The present invention is for a safety guard rail system having folding guard rails designed to be raised or lowered at their base by a single individual from an acceptable safe distance from the edge of a precipice, such as the edge of a building roof. A sliding sleeve hinge lock locks each folding rail in an erect position and can be remotely unlocked for folding the rail. An elongated grappling tool has a hook-like end for grabbing the sliding sleeve hinge lock handle for locking and unlocking the hinge lock from a distance when erecting or folding a guard rail.

14 Claims, 4 Drawing Sheets

FOLDING GUARD RAIL METHOD AND APPARATUS

FIELD OF THE INVENTION

This invention is related to a guard rail system and especially to a remotely collapsible guard rail system to form a protective safety barrier for fall prevention which rail system can be collapsed and erected remotely.

BACKGROUND OF THE INVENTION

Guard rails are installations that prevent passage in hazardous areas where a fall or other harmful conditions exist. Guard or safety rail systems have been commonly used in the past to prevent workers or other persons from falling from elevated areas such as roofs. Some fall prevention systems are temporary, such as those used during construction of a building to prevent workers from falling from the rooftop during construction. Permanent safety rails on building roofs are often not considered to be aesthetically pleasing and to detract from the beauty of the building. Safety rails are thus sometimes made to be removed when not in use so as to be out of sight except when someone is using a roof or elevated area. Some workers on a new construction job are required to wear a harness having a safety line when working close to the edge of elevated surfaces. New safety requirements require that workers or other persons on a roof not be within six feet of a building precipice or edge as a safety precaution which makes it difficult to remove and replace safety rails especially on short notice.

A collapsible rail fall prevention system such as taught by the present invention allows the rails to be collapsed and out of view until needed at which time they can be remotely raised or lowered without being within six feet of the edge of the building roof.

In the prior U.S. Patent Application Publication No. US 2006/0278472 to Kenton et al., a collapsible safety rail system is provided for a portable or permanent protective barrier to provide for fall prevention from an elevated work area. This collapsible safety rail requires a workman to unpin a detent pin and fold each hinged rail. This in turn requires a workman to be adjacent the edge of the roof in order to raise or lower the safety rail which places the workman in the danger area for a fall.

In U.S. Pat. No. 5,749,436 to Satchwell, III, a collapsible railing for mounting on a vehicle roof is provided which has a railing and a plurality of collapsible stanchions.

The Murray U.S. Pat. No. 6,053,281, is for a roof perimeter safety rail system for installation about the perimeter of a rooftop work site. The rail system has removable stanchions for connecting a cable therebetween. The Allemane U.S. Pat. No. 4,520,898 is for a folding guard rail for a platform. The rails can be erect and can be folded down over the platform and has a key to immobilize the guard rail either in its normal position or in it folded position.

The Shorey et al. U.S. Pat. No. 7,028,990 is for a temporary rooftop and stairway safety rail safety system adapted to prevent workers from falling from a work surface at a height. The pitch of the vertical extending support members can be adjusted to the slope of the work surface with removable pins.

The present invention is for a folding guard rail designed to be raised or lowered at its base by a single individual from an acceptable safe distance to comply with OSHA or related safety regulations. The individual who is raising or lowering the assembly is protected from being exposed to the hazard that the guard rail, when raised, is designed to eliminate. The rail system can be remotely collapsed and erected remotely by a worker without the worker working in or entering into the danger area adjacent the edge of the elevated area. A protective safety barrier is easily erected and collapsed remotely from several feet away from the safety rail edge of the roof or work surface.

SUMMARY OF THE INVENTION

This invention relates to a remotely folding guard rail having a safety rail having a supporting post. A base post may be fixedly attached to a building structure and has a hinge attached therebetween to allow for the folding and erecting of the safety rail between upright and folded positions. A locking sleeve is slidably mounted to the safety rail supporting post and has a handle attached thereto. The locking sleeve is adapted to slide on the safety rail supporting post and over the hinge when the safety rail is in a generally upright position to lock the rail supporting post in an upright position. An elongated grappling tool has a locking sleeve handle engaging end portion shaped for remotely engaging and lifting the locking sleeve and folding the safety rail from an erect to a folded position. A safety rail is thus held in an upright position and may be remotely lowered to a folded position.

A method of remotely folding a guard rail includes selecting a guard rail in accordance with the apparatus and selecting an elongated grappling tool having a sliding hinge lock handle engaging end portion shaped for engaging and lifting the sliding hinge lock. Then grasping and raising the sliding hinge lock handle from a distance with the elongated grappling tool to unlock the hinged rail supporting post from the base post and folding the guard rail from an erect to a folded position. A guard rail can thus be remotely moved from a locked erect position to a folded position. The process also includes the grasping of the sliding hinge lock handle of a folded guard rail with the grappling tool and raising the guard rail to an upright position where the sliding hinge lock is released to slide and lock the guard rail in an upright position.

BRIEF DESCRIPTION OF THE DRAWINGS

The accompanying drawings, which are included to provide further understanding of the invention are incorporated in and constitute a part of the specification, and illustrate an embodiment of the invention and together with the description serve to explain the principles of the invention.

In the drawings.

DETAILED DESCRIPTION OF EXEMPLARY EMBODIMENT

The present invention is for a safety guard rail system having folding guard rails 10 designed to be raised or lowered at their base by a single individual 11 from an acceptable safe distance from the edge of a precipice, such as the edge of a building roof 12.

Figure 1:
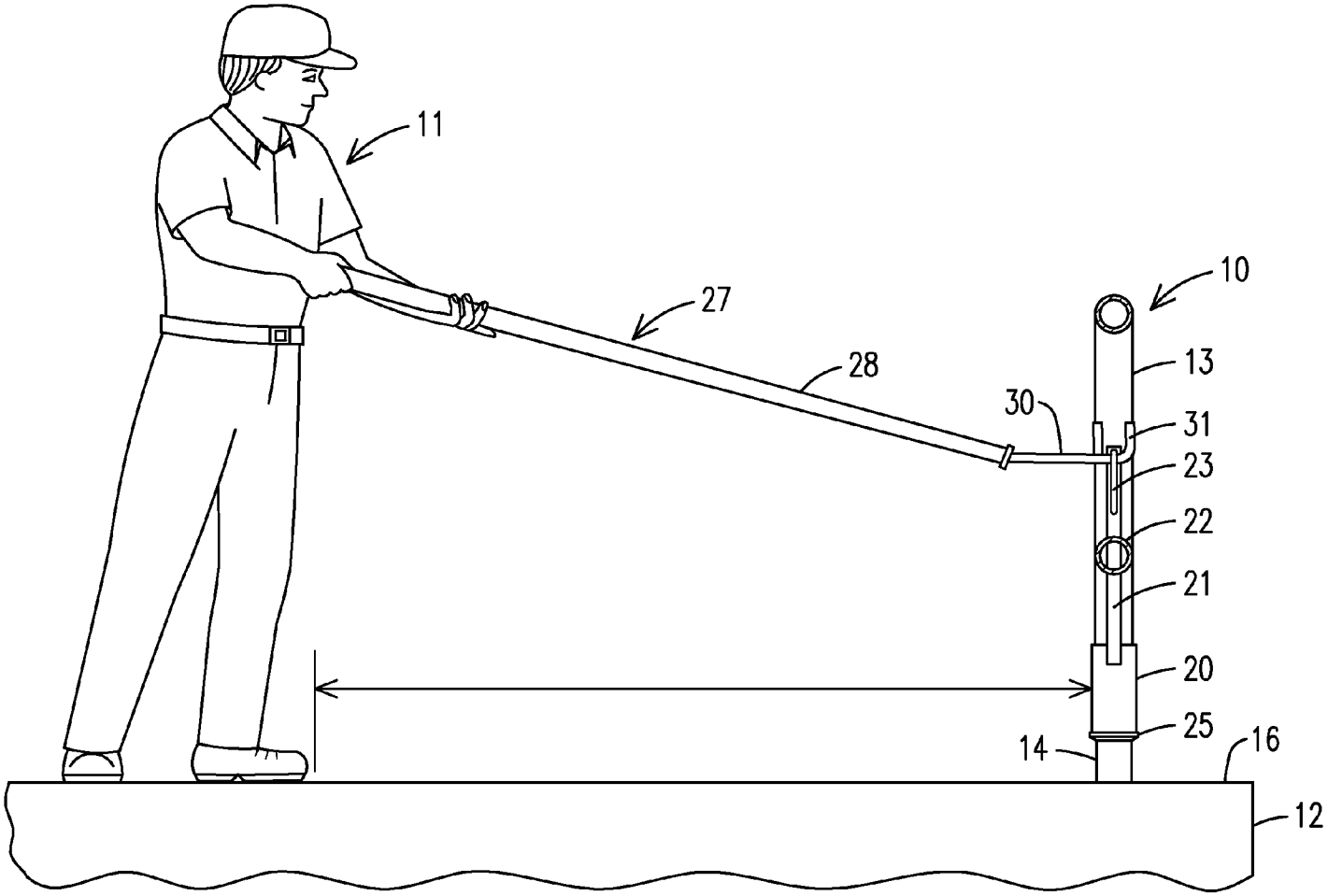
FIG. 1 is a side elevation of the guard rail system of the present invention being remotely operated by a worker.
Figure 2:
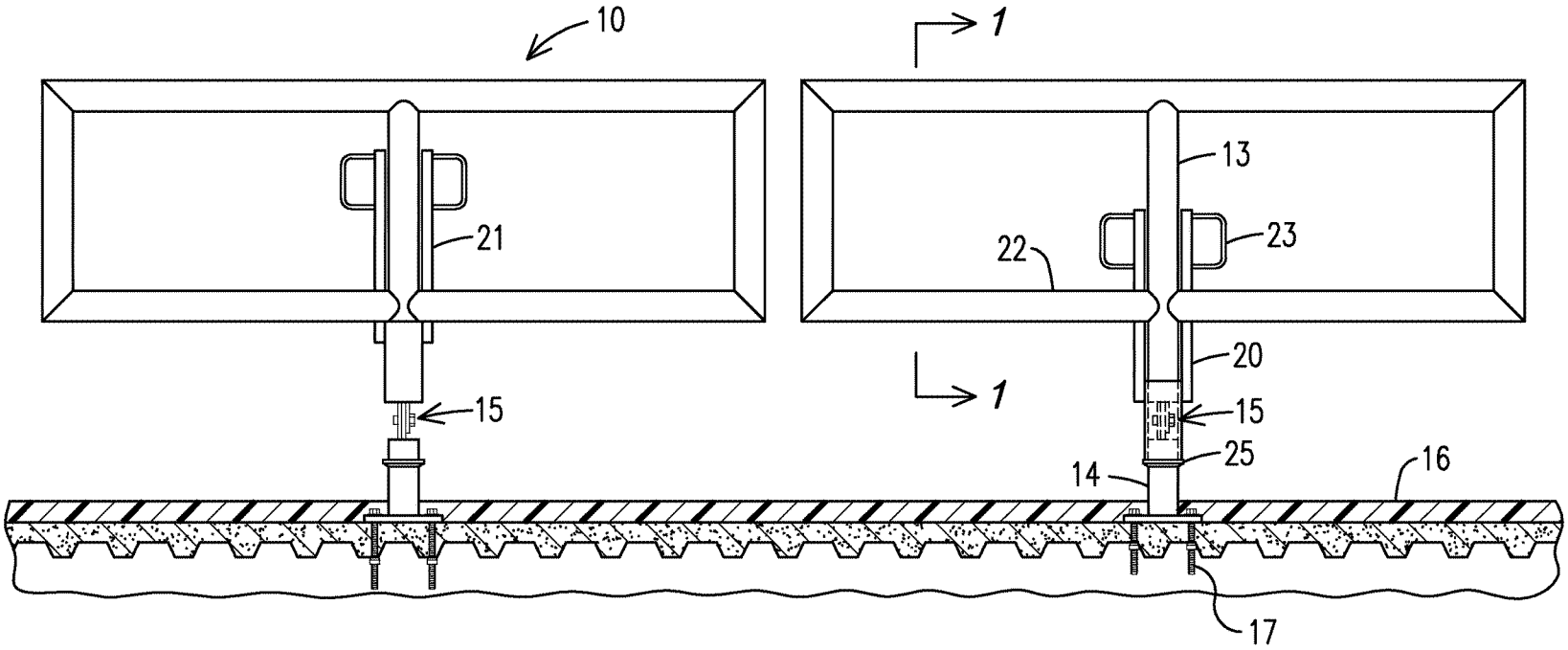
FIG. 2 is a front sectional view of the guard rails of FIG. 1 mounted to the edge of a building.

As seen in FIGS. 1 and 2, the safety or guard rails 10 have a center supporting post 13 which is hinged to a base post 14 with a hinge 15. The base post 14 is fixedly attached to the roof 15 with bolts 17 or in any fashion desired but may also be removably attached as desired, such as with a ballast or counterweight that does not require any attachment. A post locking sleeve 18 slides on the post 13 and is sized to slide over the hinge 15 and over the top portion of the base post 14. The locking sleeve 20 has a pair of elongated handle bars 21 extending from the sleeve 20 and passing through openings in the horizontal rails 22 on either side of the supporting post 13. Each elongated handle rod 21 has a handle 23 attached thereto. Each handle 23 is in a generally C-shape and fixedly attached to one of the rods 20. Gripping the handle 23 and lifting the locking sleeve 20 will raise the sleeve above the hinge 15 and allow the rail 10 to be folded on the hinge 15.

Figure 6:
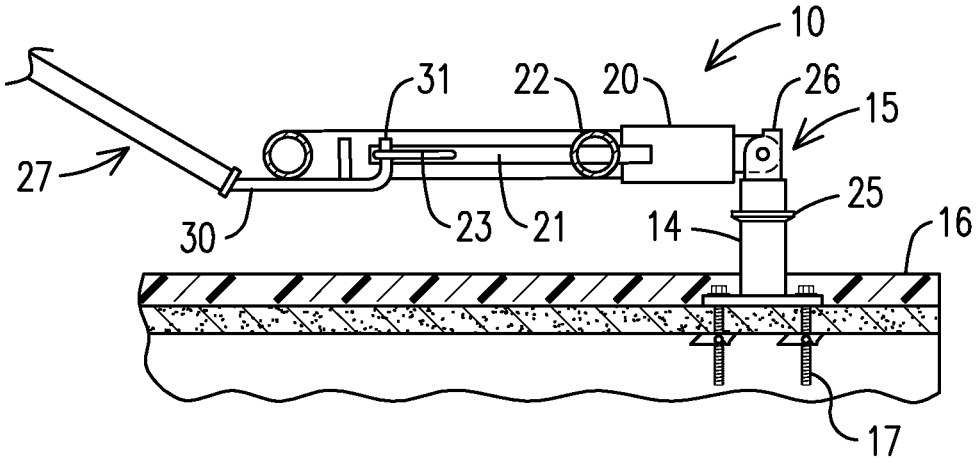
FIG. 6 is a side sectional view of the guard rail of FIGS. 3, 4, and 5 with the guard rail fully collapsed.

In setting up a folded safety rail 10, the sleeve 20 can be raised while raising the post 13 and rail 10 allows the rail to be erected so that when the handles are released, the sleeve 20 will fall of its own weight to cover the hinge 15 and over the top portion of the base post 14. It will of course be clear that the sleeve 20 can be spring biased without departing from the spirit and scope of the invention. A stop ring 25 stops the sliding sleeve 20 at a predetermined point to lock the hinged post 13 erect. A stop ledge 26 extending from the base post 14, as seen in FIG. 6, will guide the locking sleeve 20 over the hinge 15.

An elongated grappling tool has an elongated pole 28 having a locking sleeve handle engaging end portion 30 shaped for remotely engaging and lifting the unlocking sleeve 20 handle 23, as seen in FIG. 1. The locking sleeve handle engaging end portion 30 has a generally U-shaped end 31 sized to fit within the handle 23 for lifting the handle 23 and locking sleeve 20 and then folding the safety rail 10 on the hinge 15 from an erect to a folded position. The grappling tool 27 can also be used to grip the handle 23 when the rail 10 is folded to lift the folded rail 10 to an upright position where the handle can be lowered to lock the post 13 and safety rail 10 in an upright or erect position.

Figure 3:
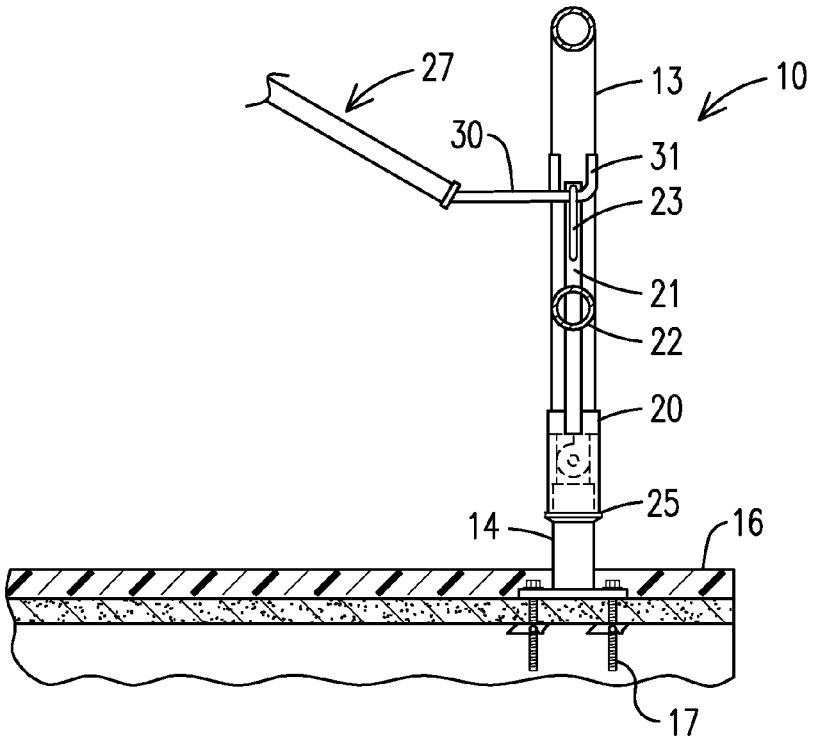
FIG. 3 is a side sectional view of the guard rail of FIGS. 1 and 2 with the grappling tool being positioned in the lock handle.

The process of the present invention can be more clearly seen in connection with FIGS. 3 through 6 where the base post 14 is fixedly attached to a roof 16 with bolts 17. The base post can also be removably mounted to the roof such as with a ballast or counterweights. The base post 14 has a stop ring 25 attached thereto. The hinge 15 hingedly attaches the base post 14 to the center supporting post 13. In FIG. 3, the grapple tool 27 has the U-shaped or hooked end 31 of the locking sleeve handle engaging end portion 30 engaging the handle 23 of the locking sleeve 20 rods 21. The locking sleeve 20 extends over the hinge 15 and over the top of the base post 14 and abuts the stop ring 25 to lock the center support post 13 and rail 10 in an upright position as a safety guard rail. The extending handle bars 21 slide through the rails 22.

Figure 4:
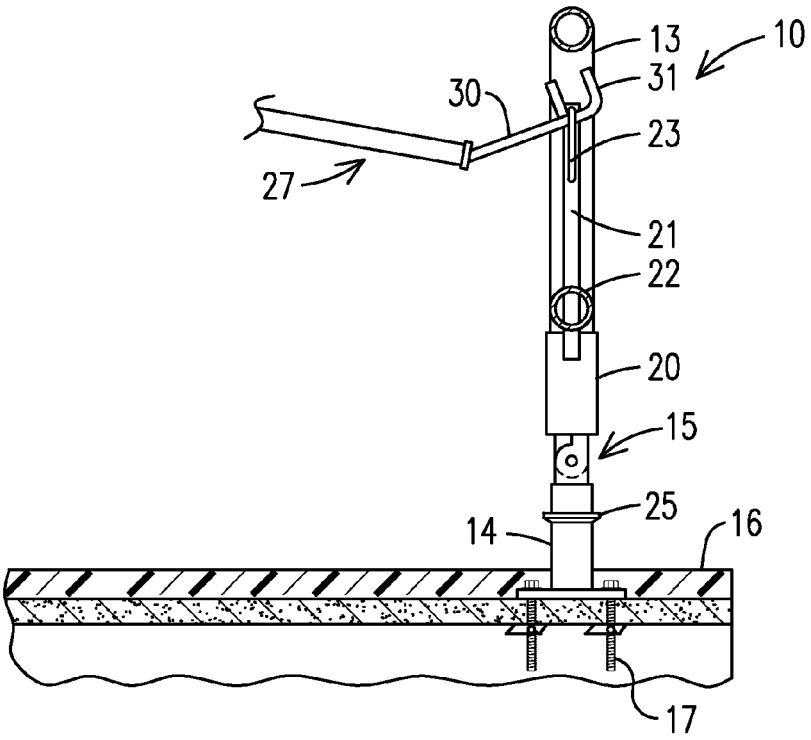
FIG. 4 is a side sectional view of the guard rail of FIG. 3 having the lock handle being raised.
Figure 5:
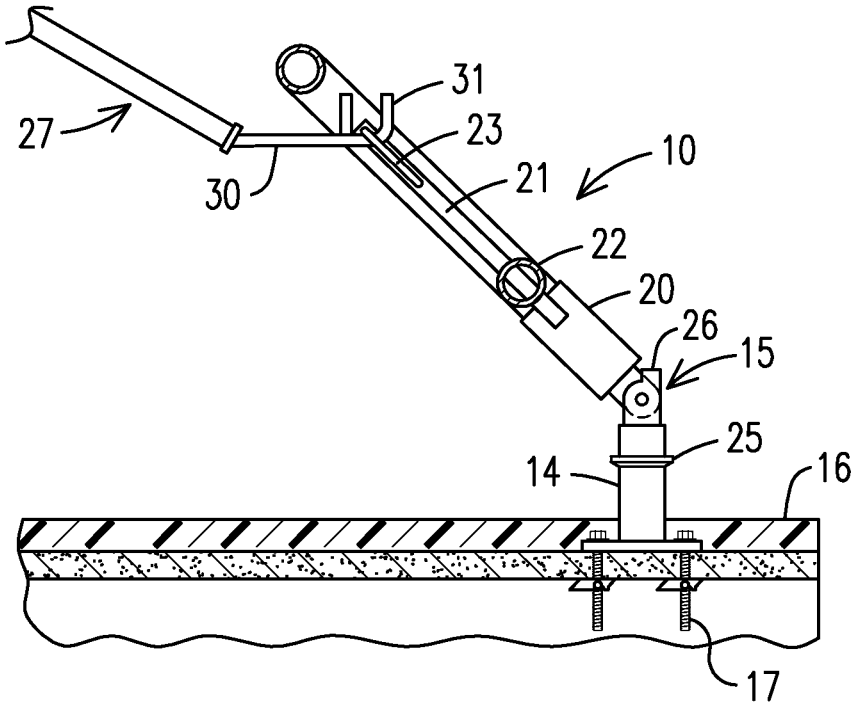
FIG. 5 is a side sectional view of the guard rail of FIGS. 3 and 4 having the grapple tool collapsing the guard rail.

In FIG. 4 the safety rail 10 is being lifted by the worker 11 of FIG. 1 and has raised the locking sleeve 20 above the hinge 15 to free the support post 13 for folding the safety rail 10. The worker then pulls the grapple tool 27 to pull on the handle 23 and to start folding the support post 13 and rail 10, as seen in FIG. 5. The safety rail 10 is then let down into a completely folded position as seen in FIG. 6.

It should also be clear that the rail 10 can be raised by the reverse sequence of grabbing the handle 23 in the folded position as shown in FIG. 6 and raising the rail 10 as in FIGS. 5 and 4 to an erect position and then lowering the handle 23 and locking sleeve 20 as in FIG. 3 to lock the rail 10 in an upright guard rail position. This operation takes place with the worker 11 spaced at a safe distance from the edge 12 of the roof 16 which may be 5 or 6 feet away from the edge 12 or as required by current regulations.

It should be clear at this time that a safety guard rail system having folding guard rails designed to be raised or lowered at their base by a single individual from an acceptable safe distance from the edge of a precipice has been provided. However the present invention is not to be considered limited to the forms shown which are to be considered illustrative rather than restrictive.

We claim:

1. A remotely folding guard rail system comprising:

a safety rail having at least one horizontal rail and a vertical rail supporting post;

a base post attached to a building structure and having a hinge attached between an upper end of said base post and a lower end of said safety rail supporting post for folding said safety rail between an upright position and a folded position;

a locking sleeve slidably mounted to said safety rail supporting post, said locking sleeve having a handle attached thereon and being adapted to slide on said safety rail supporting post and over said hinge when said safety rail is in a generally upright position in which said rail supporting post is aligned with said base post to lock said rail supporting post in said upright position; and an elongated grappling tool having a locking sleeve handle engaging end portion shaped for remotely engaging said handle and lifting said locking sleeve above said hinge to allow said safety rail to be folded about said hinge from said upright position to said folded position;

whereby the safety rail held in the upright position may be remotely lowered to the folded position.

2. The remotely folded guard rail system in accordance with claim 1 in which said locking sleeve has an elongated handle bar extending therefrom having said handle attached thereto.

3. The remotely folding guard rail system in accordance with claim 2 in which said locking sleeve has two elongated handle bars extending therefrom each having a handle attached thereto.

4. The remotely folding guard rail system in accordance with claim 2 in which said handle is a generally C-shaped handle attached to the elongated handle bar of said locking sleeve.

5. The remotely folding guard rail system in accordance with claim 1 in which said base post has a stop ring thereon for limiting the sliding movement of said locking sleeve over said hinge and base post when said rail is in said upright position.

6. The remotely folding guard rail system in accordance with claim 1 in which said elongated grappling tool locking sleeve handle engaging end portion includes a generally U-shaped handle engaging portion.

7. The remotely folding guard rail system in accordance with claim 1 in which said base post has a supporting post stop for positioning said supporting post in a predetermined upright position.

8. The remotely folding guard rail system in accordance with claim 1 in which said elongated grappling tool is at least five feet in length.

9. The remotely folding guard rail system in accordance with claim 1 in which said base post is fixedly attached to a building structure.

10. The remotely folding guard rail system in accordance with claim 1 in which the locking sleeve is spring biased to slide on said rail supporting post.

11. A method of remotely folding a guard rail comprising the steps of:

selecting a guard rail having at least one horizontal rail and a vertical rail supporting post and having a base post attached to a building structure, a lower end of said rail supporting post being hingedly attached to an upper end of said base post via a hinge and said rail supporting post having a sliding hinge lock having a handle thereon and being adapted to slide on said rail supporting post and over said hinge when said guard rail is in a generally upright position in which said rail supporting post is aligned with said base post to lock said rail supporting post in said upright position;

selecting an elongated grappling tool having a sliding hinge lock handle engaging end portion shaped for engaging and lifting said sliding hinge lock;

grasping and raising said sliding hinge lock handle from a distance with said elongated grappling tool to lift said sliding hinge lock above said hinge to unlock said hinged rail supporting post from said base post to allow said guard rail to be folded about said hinge; and folding said guard rail from said upright position to a folded position;

whereby the guard rail is remotely moved from the locked upright position to the folded position.

12. The method of remotely folding a guard rail in accordance with claim 11 including the step of grasping said sliding hinge lock handle with said grappling tool and raising said guard rail to said upright position.

13. The method of remotely folding a guard rail in accordance with claim 12 including the step of releasing said sliding hinge lock of said raised guard rail to lock the raised guard rail in said upright position.

14. The method of remotely folding a guard rail in accordance with claim 13 in which said selected guard rail base post is fixedly attached to a building structure.

* * * * *